US009220391B1

(12) United States Patent
Henninger

(10) Patent No.: US 9,220,391 B1
(45) Date of Patent: Dec. 29, 2015

(54) SPONGE HOLDER

(71) Applicant: Judy Deanna Henninger, Corona, CA (US)

(72) Inventor: Judy Deanna Henninger, Corona, CA (US)

( * ) Notice: Subject to any disclaimer, the term of this patent is extended or adjusted under 35 U.S.C. 154(b) by 0 days.

(21) Appl. No.: 13/675,146

(22) Filed: Nov. 13, 2012

Related U.S. Application Data

(60) Provisional application No. 61/648,606, filed on May 18, 2012.

(51) Int. Cl.
*B65D 25/24* (2006.01)
*A47L 13/16* (2006.01)
*B65D 85/00* (2006.01)

(52) U.S. Cl.
CPC ..... *A47L 13/16* (2013.01); *B65D 85/00* (2013.01)

(58) Field of Classification Search
CPC ..... B65D 85/00; A47L 13/16
USPC ..... 220/480, 23.4, 4.31, 481; 206/361
See application file for complete search history.

(56) References Cited

U.S. PATENT DOCUMENTS

| | | | | | |
|---|---|---|---|---|---|
| 2,149,612 | A * | 3/1939 | Madsen | 206/229 |
| 2,717,717 | A * | 9/1955 | Busch | 220/483 |
| 3,207,355 | A * | 9/1965 | Saphier | 220/481 |
| 3,688,943 | A * | 9/1972 | Brown | 220/697 |
| 4,784,082 | A * | 11/1988 | Wolfe | 119/167 |
| 6,059,135 | A * | 5/2000 | James et al. | 220/23.4 |
| 7,878,364 | B1 * | 2/2011 | Anderson | 220/735 |
| 8,037,999 | B1 * | 10/2011 | Kumar | 206/77.1 |
| 2009/0242441 | A1 * | 10/2009 | Laskey | 206/361 |

* cited by examiner

*Primary Examiner* — Jeffrey Allen
(74) *Attorney, Agent, or Firm* — Plager Schack LLP

(57) ABSTRACT

A sponge holder allows a user both to store new dry sponges in a dry environment and to hold and dry a wet sponge. The sponge holder comprises a dry container detachably coupled to a drying container. The dry container further comprises a lid that can be opened to insert the dry sponges. The lid should partially cover the sponge holder such that water cannot permeate the dry container which keeps the dry sponges dry and free of contamination. The drying container further comprises at least one open end through which the wet sponge can be placed, vents and a reservoir in order to allow the wet sponge to dry. The drying container can be detached from the drying container allowing for portability and ease of use.

1 Claim, 4 Drawing Sheets

SPONGE HOLDER

CROSS REFERENCE TO RELATED APPLICATIONS

This application claims priority to U.S. Provisional Patent Application 61/648,606 filed on May 18, 2012 which is incorporated by reference.

FIELD OF THE INVENTION

This invention relates to apparatus which hold cellular mass devices, where the cellular mass devices are used for cleaning.

BACKGROUND OF THE INVENTION

New sponges are difficult to keep organized in one place once they are removed from the original packaging. New sponges are typically stored loose in kitchen drawers along with other household items, are stacked in the pantry, or under the sink next to other cleaning products. A sponge that is being used is kept on top of the sink and often ends up being knocked into the sink, landing in dirty water or dirty dishes.

Prior art sponge holders do not provide for organized storage of new sponges along with the sponge in use. They do not provide the flexibility of two containers, which can be used separately. Prior art sponge holders do not provide the flexibility to securely attach the container in multiple locations. They only allow the container to be used sitting on the counter top, or attached to the inside of the sink wall, or hung from on top a cupboard door. Prior art sponge holders are unstable and are much easier to have the sponge knocked into the sink or onto the floor.

The present invention provides for storage and organization of both new and used sponges. It can be attached to the inside of a cupboard door, keeping sponges out of sight and organized. The present invention provides the ability to easily find sponges and replace a used sponge with a new sponge once it has been worn out. It provides a simple detachable container for the sponge being used while keeping the new sponges in an enclosed container making it easier to reach and replace sponges as they are needed. The present invention can be taken apart for easy cleaning in the dishwasher, and to allow for a portable container for the sponge being used.

BRIEF SUMMARY OF THE INVENTION

A sponge holder allows a user both to store dry sponges in a dry environment and to dry a wet sponge. The sponge holder comprises a dry container detachably coupled to a drying container. The dry container further comprises a lid that can be opened to insert the dry sponges. The lid should partially cover the sponge holder such that water cannot permeate the dry container which keeps the dry sponges dry and free from contamination. The drying container further comprises at least one open end through which the wet sponge can be placed, vents on three sides and a reservoir in order to allow the wet sponge to dry.

The dry container further comprises the lid which is operated by rotation about a hinged axis. The lid further comprises a lid handle for operating the lid about the hinged axis. In this manner, the lid covers the dry container and is better able to keep the water out of the dry container which keeps the dry sponges dry and free from contamination.

The dry container comprises a container rail that can be affixed to a container slot on the drying container creating a mechanical couple. This provides stability to both containers and separation to allow sponges in the drying container to dry in a rapid and efficient manner.

The mechanical couple further comprises a unidirectional stop which allows the drying container to slide into a fixed position in relation to the dry container. This supports the drying container, and which allows for decoupling of the containers in order to clean the drying container separately.

The dry container further comprises a surface mount bracket ring. The user can mechanically couple the surface mount bracket ring to a surface mount bracket hook. A surface mount bracket can be mechanically coupled to a mount surface by an adhesive surface. The user can mechanically couple the dry container to the mount surface by mechanically coupling the surface mount bracket to the mount surface and then mechanically coupling the dry container to the surface mount bracket.

In this manner the sponge holder can be mounted to the mount surface in a position that is convenient for the user to insert the wet sponge and retrieve the dry sponges.

BRIEF DESCRIPTION OF THE SEVERAL VIEWS OF THE DRAWINGS

Figure 1:
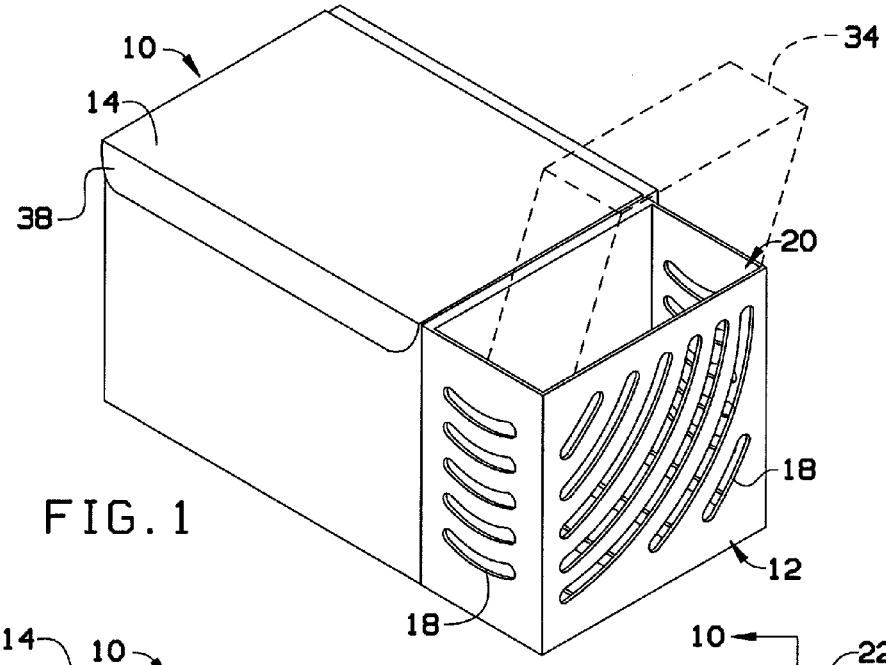

Having thus described the invention in general terms, reference will now be made to the accompanying drawings, which are not necessarily drawn to scale, and wherein:

FIG. 1 is a perspective view of the invention shown in use.

Figure 2:
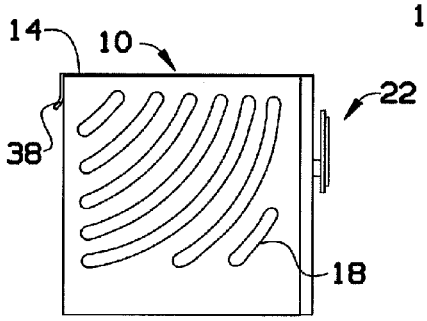

FIG. 2 is a side view of the invention.

Figure 3:
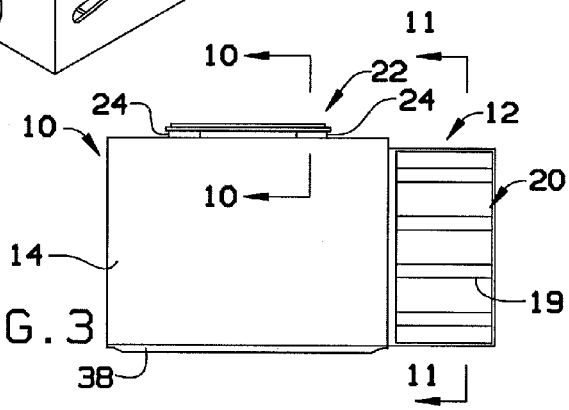

FIG. 3 is a top view of the invention.

Figure 4:
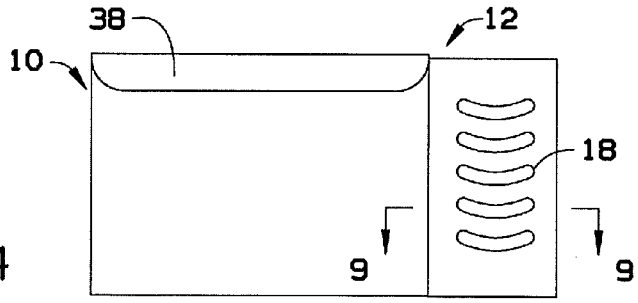

FIG. 4 is a front view of the invention.

Figure 5:
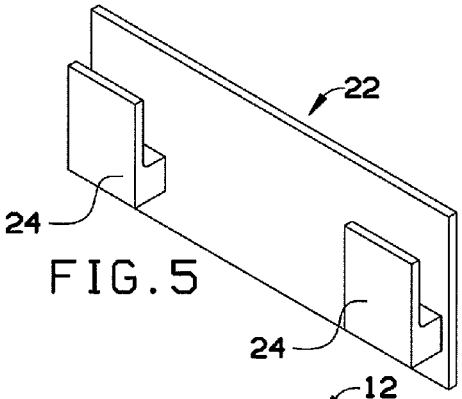

FIG. 5 is a forward perspective detail view of the surface mount bracket only.

Figure 6:
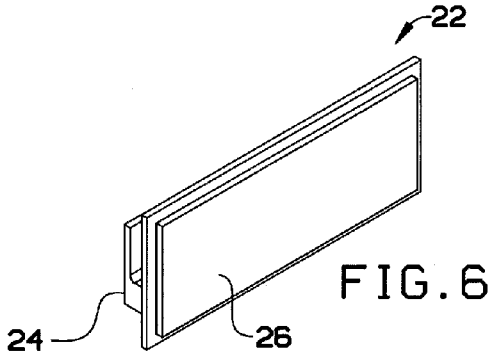

FIG. 6 is a rear perspective detail view of the surface mount bracket only.

Figure 7:
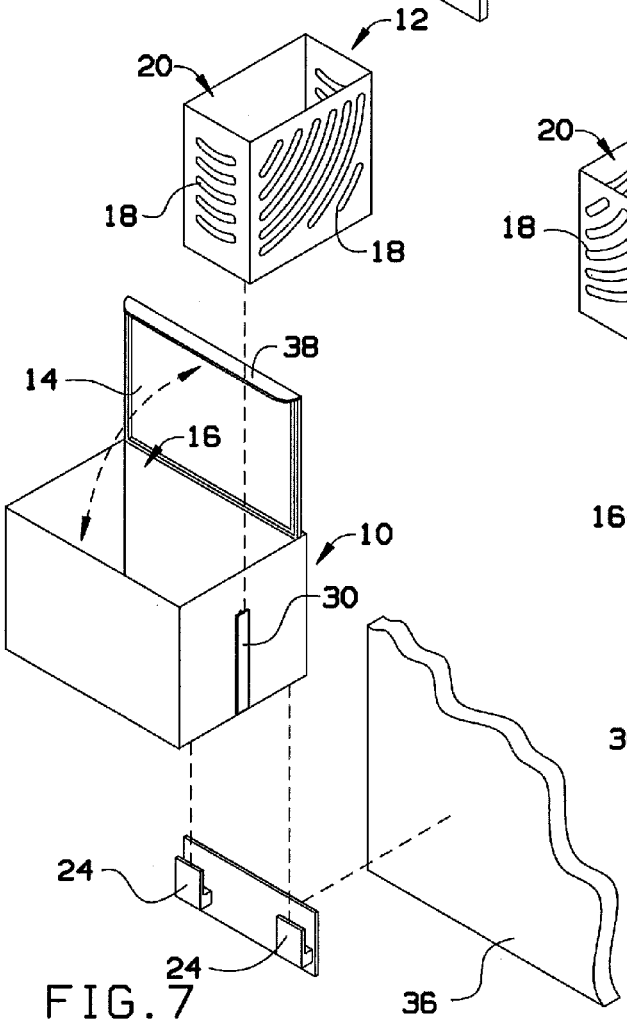

FIG. 7 is a forward perspective exploded view of the invention illustrating range of motion of the lid.

Figure 8:
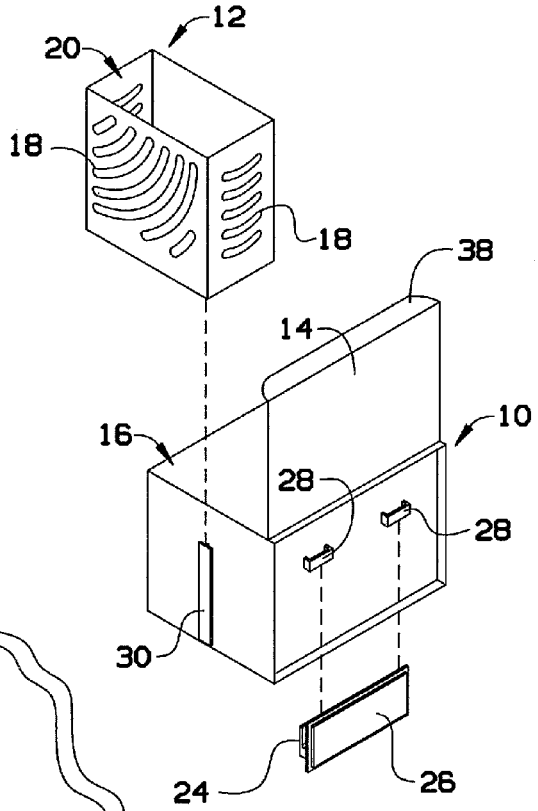

FIG. 8 is a rear perspective exploded view of the invention.

Figure 9:
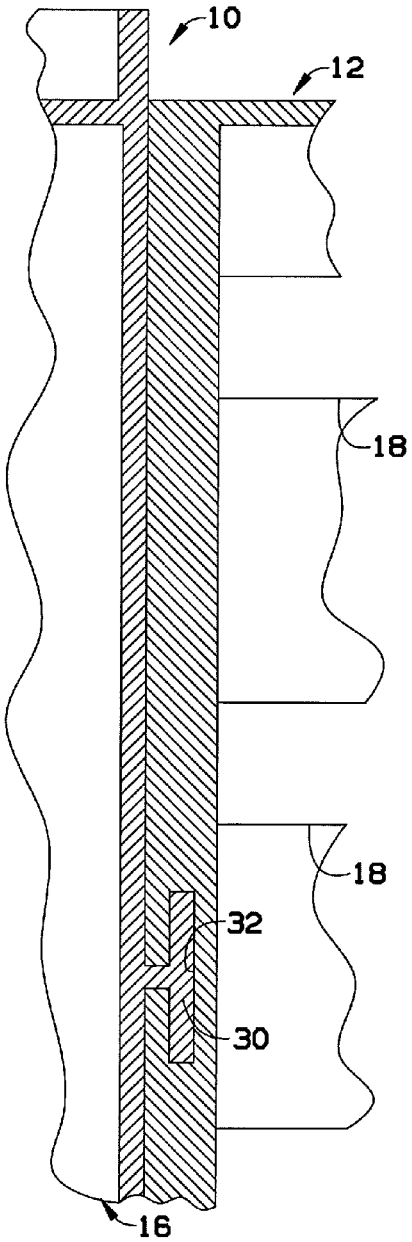

FIG. 9 is a section detail view of the invention along line 9-9 in FIG. 4.

Figure 10:
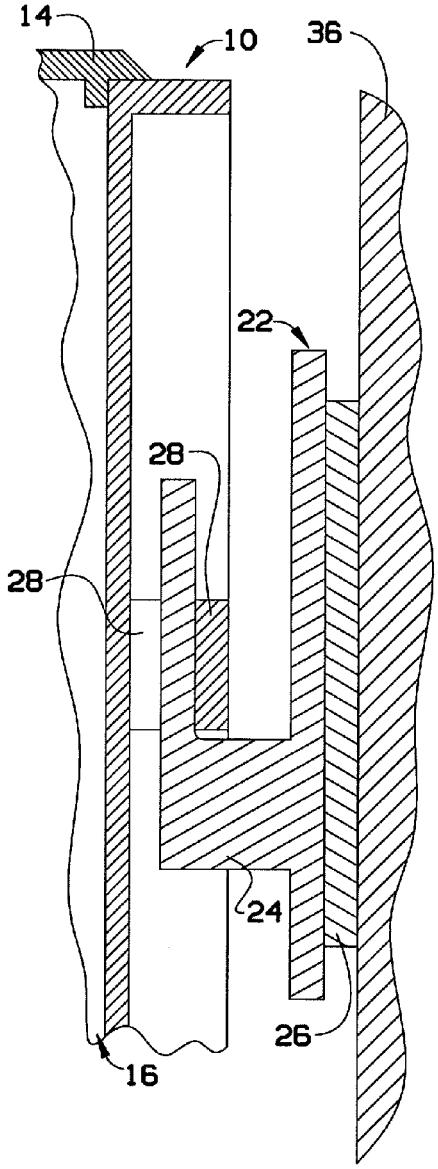

FIG. 10 is a section detail view of the invention along line 10-10 in FIG. 3.

Figure 11:
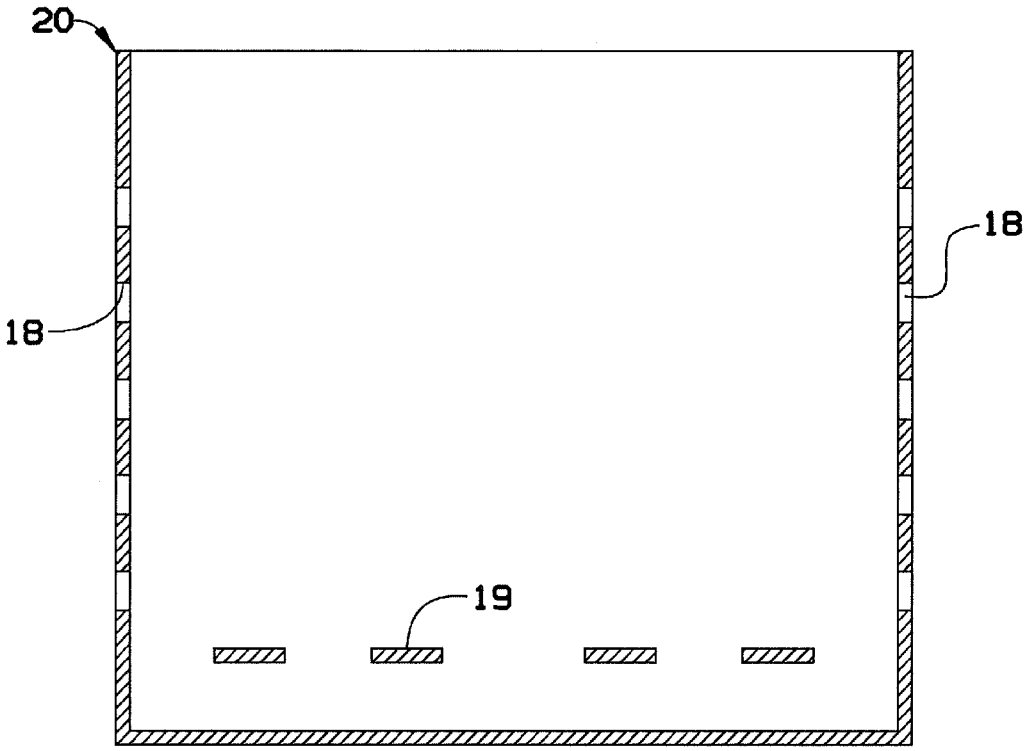

FIG. 11 is a section detail view of the invention along line 11-11 in FIG. 3.

DETAILED DESCRIPTION OF THE INVENTION

Embodiments of the present invention overcome many of the obstacles associated with storing wet and dry sponges in a singular container, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 11 show a sponge holder. The sponge holder comprises dry container 10 which can be mechanically coupled to drying container 12 as shown below. Drying container 12 further comprises sponge-in-use cavity 20, dry vent 18 and sponge support slat 19. In this manner, drying container 12 has vents on three sides and a reservoir that can accommodate sponge 34. Dry container 10 further comprises lid 14 which further comprises handle 38.

FIG. 2 shows another view of dry container 10. As noted above, dry container 10 comprises lid 14 which further comprises handle 38. Dry container 10 is mechanically coupled to surface mount bracket 22. Dry container 10 comprises dry vent 18. Since lid 14 covers dry container 10, water cannot permeate dry container 10 creating a dry environment.

FIG. 3 and FIG. 4 show more views of dry container 10. As noted above, dry container 10 is mechanically coupled to drying container 12, which further comprises sponge-in-use cavity 20 and dry vent 18. Dry container 10 further comprises lid 14 which further comprise a lid handle 38. Lid 14 covers at least one open end of dry container 10, and can be opened or closed along a hinged axis. Here, surface mount bracket 22 further comprises surface mount bracket hook 24.

FIG. 5 and FIG. 6 shows surface mount bracket 22 more detail. Surface mount bracket 22 comprises a front side and the back side. The front side further comprises surface mount bracket hook 24. The back side further comprises adhesive surface 26.

FIG. 7, FIG. 8, FIG. 9 and FIG. 10 provide instructions on how to construct dry container 10. Dry container 10 further comprises container rail 30. Drying container 12 further comprises container slot 32. The user can create a mechanical couple between dry container 10 and drying container 12 by sliding container slot 32 along container rail 30. The mechanical couple further comprises a unidirectional stop which allows drying container 12 to slide into a fixed position in relation to the dry container 10. The unidirectional stop supports the weight of the drying container 12, and which allows for decoupling of the containers in order to clean and use drying container 12 separately. This provides stability to both containers and separation to allow a wet sponge 34 in drying container 12 to dry in a rapid and efficient manner.

Dry container 10 further comprises surface mount bracket ring 28. The user can mechanically couple surface mount bracket ring 28 to surface mount bracket hook 24. Surface mount bracket 22 can be mechanically coupled to mount surface 36 by adhesive surface 26. The user can mechanically couple dry container 10 to mount surface 36 by mechanically coupling surface mount bracket 22 to mount surface 36 and then mechanically coupling dry container 10 surface mount bracket 22. In this manner, the sponge holder can be mounted to mount surface 36 in a position that is convenient for a user to insert wet sponges 34 and retrieve dry sponges 34.

That which is claimed:

1. A sponge holder allows a user both to store dry sponges in a dry environment and to dry a wet sponge, the sponge holder consisting of, a dry container detachably coupled to a drying container, where the dry container having a lid that can be opened to insert the dry sponges, the lid partially covers the sponge holder such that water cannot permeate the dry container which keeps the dry sponges dry and free from contamination;

the drying container having at least one open end through which the wet sponge can be placed, vents on a first side, additional vents on a second side, and further additional vents on a third side, and having a bottom on a fourth side and a solid unperforated fifth side; wherein the first side, the second side, the third side, the fourth side and the fifth side are arranged into a parallelepiped, a first solid support slat, attached to the first side and the fifth side parallel to the bottom; and offset by a first space from the second side;

a second solid support slat, attached to the first side and the fifth side parallel to the first solid support slat and the bottom; wherein the second support slat is separated by a second space from the first support slat;

a third solid support slat, attached to the first side and the fifth side parallel to the second solid support slat and the bottom; wherein the third support slat is separated by a third space from the second support slat;

a fourth solid support slat, attached to the first side and the fifth side parallel to the third solid support slat and the bottom; wherein the fourth support slat is separated by a fourth space from the third support slat;

wherein only the first side and the fifth side contact perpendicular to the solid support slats;

wherein the support slats lift the sponge from a reservoir which exists between the support slats and the bottom, and permits the wet sponge to dry without resting in fluid previously held within the wet sponge the mechanical couple having a unidirectional stop which allows the drying container to slide into a fixed position in relation to the dry container, this supports the drying container, and which allows for decoupling of the containers in order to clean the drying container separately, and use the drying container separately;

the dry container having the lid which is operated by rotation about a hinged axis; the lid further having a lid handle for operating the lid about the hinged axis; in this manner, the lid covers the dry container and is better able to keep the water out of the dry container which keeps the dry sponges dry and free from contamination;

the dry container having a surface mount bracket ring; the user can mechanically couple the surface mount bracket ring to a surface mount bracket hook; a surface mount bracket can be mechanically coupled to a mount surface by an adhesive surface; the user can mechanically couple the dry container to the mount surface by mechanically coupling the surface mount bracket to the mount surface and then mechanically coupling the dry container to the surface mount bracket;

wherein the sponge holder is adapted to be mounted to the mount surface in a position that is convenient for the user to insert the wet sponge and retrieve the dry sponges.

* * * * *